United States Patent [19]

Spacek et al.

[11] 4,229,965

[45] Oct. 28, 1980

[54] HYDRAULIC CIRCUIT OF A HYDROMECHANICAL DRAWING PRESS

[75] Inventors: Jindrich Spacek, Brno; Jiri Kosek, Zdar, both of Czechoslovakia

[73] Assignee: Vyzkumny ustav tvarecich stroju a technologie, Brno

[21] Appl. No.: 892,288

[22] Filed: Mar. 31, 1978

[30] Foreign Application Priority Data

Apr. 5, 1977 [CS] Czechoslovakia ..... 2256-77

[51] Int. Cl.[3] ..... B21J 9/18

[52] U.S. Cl. ..... 72/453.13; 72/20; 267/119

[58] Field of Search ..... 72/20, 352, 453.13; 267/119

[56] References Cited

U.S. PATENT DOCUMENTS

| | | | |
|---|---|---|---|
| 2,890,669 | 6/1959 | Williamson | 72/20 |
| 3,085,530 | 4/1963 | Williamson | 72/453.13 |
| 3,491,565 | 1/1970 | Birman | 72/DIG. 31 |

*Primary Examiner*—Leon Gilden

[57] ABSTRACT

There is disclosed a hydraulic circuit of a press for the hydromechanical drawing of pressings or workpieces in a pressure chamber forming the drawing die which includes at least two spaces for the fluid separated from each other by at least one piston transmitter. At least one of the spaces for the fluid in the pressure chamber separated from the pressure fluid for the forming of the pressing by the piston transmitter is connected by means of a connection branch with a controlled throttle valve with the hydraulic unit of the main working cylinder of the press which drives the drawing punch of the press. To the space for the fluid in the pressure chamber, which is separated by the piston transmitter from the pressure fluid for forming the pressing, is connected a filling branch with a return valve incorporated by means of a hydraulic distributor in the circuit of a hydrogenerator for driving the main working cylinder of the press. The controlled throttle valve is incorporated in a feedback circuit including an auxiliary hydrogenerator as a reference source of pressure fluid for the piston of the controlled throttle valve.

6 Claims, 2 Drawing Figures

HYDRAULIC CIRCUIT OF A HYDROMECHANICAL DRAWING PRESS

Figure 1:
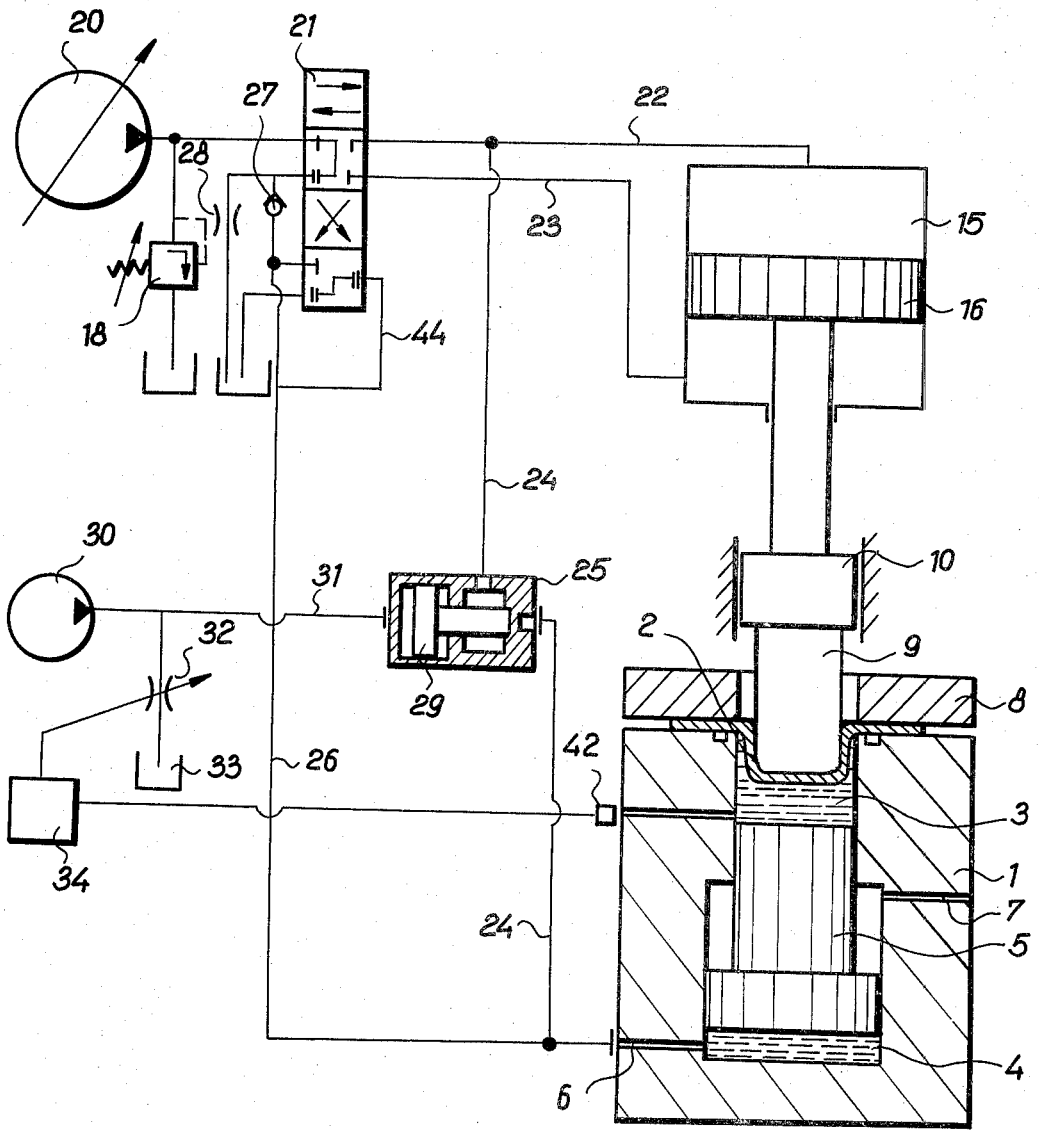

This application is related to co-assigned application of Spacek et al, Ser. No. 892,892, filed Apr. 3, 1978, which is included by reference thereto in its entirety. The invention has among its objects the provision of a hydraulic circuit press for the hydromechanical drawing of pressings or workpieces in a pressure chamber forming the drawing die, such chamber including at least two spaces for the fluid separated from each other by at least one piston transmitter.

Known devices for hydromechanical drawing, especially the deep drawing of sheet metal, have distinct advantages over the orthodox drawing of sheet metal, especially when intricate pressings are involved, e.g., of a conical, spherical, parabolic or non-symmetrical shape. Hydromechanical drawing usually ensures the formation of a pressing of the required shape after one drawing operation and a completely smooth surface of the pressing, which results from the fact that the sheet metal is not slid over the edge of a drawing ring of the drawing die but is continuously forced away from it by the pressure of the liquid filling, e.g, water in the drawing die.

In the hydromechanical drawing of pressings having certain non-typical shapes, the said conditions cannot be held because the pressure of the liquid filling at the beginning of the drawing operation does not attain the required value, whereby either the sheet is slid over the said edge of the drawing ring of the drawing die in an undesirable manner or it becomes wavy, so that the future pressing is deteriorated. Furthermore, the low pressure of the fluid in the pressure chamber at the beginning of the drawing operation may, with intricate pressings especially those having, e.g., various outer or inner projections or ribs, cause these shapes to be formed only very inadequately and remain so even during the drawing of the main portion of the pressing when the pressure in the pressure chamber has reached the required value.

Usually, however, the said projecting portions or those which have not been completely formed during drawing of the main portion of the pressure, tear away, which happens especially with deep pressings. This is due to the fact that the material for the formation of the said projecting portions of the pressing in the course of the further penetration of the drawing punch are not formed from metal withdrawn from the border of the sheet blank but are formed from the wall of the pressing surrounding the corresponding portion of the drawing punch.

With the existing devices for the hydromechanical drawing of metal sheets, it is known that metal chips accumulate in the pressure chamber, which chips must be removed from time to time to eliminate the risk of their causing defects in the control device which releases fluid from the pressure chamber. The released fluid, which forms in substance an elastic cushion for the pressing being formed, is further contaminated by various admixtures, especially lubricant which is applied to the sheet blanks before beginning the drawing operation. The fluid is thus deteriorated; this condition, as in the case of metal chips, may result in defects in the control device for releasing the fluid from the pressure chamber.

Besides these facts, it is also a drawback of the known hydromechanical drawing devices that it is not possible by standard control elements to regulate the pressure of the fluid in the pressure chamber during the drawing of the pressing. Suitable known means useable for controlling the pressures in the pressure chamber are of intricate design, difficult to operate or rather insensitive, and are usually unsuitable to be incorporated in circuits of an automated press control system. Because of cavitation in the liquid due to the high pressure of the fluid released from the pressure chamber, the control throttle valves used up to now have frequently developed defects impairing the drawing of pressings.

When releasing fluid from the pressure chamber into the tank of the fluid supply systems, in known hydromechanical drawing devices there is a considerable consumption of the energy applied for compressing the fluid in the pressure chamber during the drawing of the pressing.

Because the fluid released must be cooled, filtered, and then returned to the chamber, etc., various devices are incorporated in known machines for hydromechanical drawing which perform these functions. These devices not only increase the overall cost of the press, but because of their usual arrangement in the press foundations they increase the height of the press and, together with the design of known pressure chambers, inhibit the creation of a new design of presses not having the usual bottom portions which up to now always reach deeply below the level of the shop floor.

Finally, existing designs consume much energy. The majority of the hyraulic elements operate under high pressures, and require a separate hydrulic circuit which is costly and not reliable.

In order to eliminate the drawbacks of known devices for the hydromechanical drawing of pressings, pressure chambers have been designed in accordance with the above referred to co-assigned Spacek et al U.S. patent application, such chambers having at least two spaces for the fluid separated from each other by at least one piston transmitter.

A first one of the separate spaces of such pressure chamber filled with fluid, e.g., water, serves as a drawing die for the formation of the sheet pressing, while the other, second one of the separated spaces, together with the fluid filling, e.g., a hydraulic volume, forms the control medium for controlling the variations of movement of the said piston transmitter. By varying the movement of the piston transmitter under the action of the pressure of the fluid filling in the second of the separated spaces, the required pressure conditions and changes therein are produced in the first space of the pressure chamber for the formation of the sheet pressing.

Each of the two separated spaces of the pressure chamber, together with the respective fluid filling therein, also serves as a control medium, e.g., for floating plungers passing axially slidably through the piston transmitter and bearing at at least one of their two ends with a low counterpressure against the bottom of the sheet pressing being drawn. Such arrangement results in a saving in the energy required to overcome the deformation resistance and to compress the fluid in the respective space of the pressure chamber.

The present invention represents a further development of pressure chambers for the hydromechanical drawing of sheet pressings and pressure chambers with separated spaces for the fluid in which the separated spaces are connected by a suitable connection, and provides suitable means with the hydraulic circuit of the press to permit the utilization of the fluid filling of the said hydraulic circuit of the press and also all or some of the hydraulic systems and hydraulic elements of this circuit for the supply or distribution of the fluid filling and controlling the pressure chamber as one part of a system for the formation of sheet pressings of hydromechanical drawing and together with it to obtain distinct savings of energy.

The invention has among its objects the elimination of the drawbacks of known pressure chambers, and seeks to obtain new effects in the field of the hydromechanical drawing of sheet pressings. In accordance with the invention at least one of the spaces for fluid in the pressure chamber is connected to the pressure circuit of the main hydraulic cylinder for the press slide, the connection being throttled to obtain a pressure differential in the fluid being released.

Of particular advantage in the system according to the invention is the fact that the pressure chamber as one part of the system for the hydromechanical drawing of sheet pressings obviates the need for filling and throttling hydraulic systems and elements which are exposed to high pressures, whereby the risk of defects in releasing the fluid is reduced to an absolute minimum.

An extraordinary contribution of the interconnection of the hydraulic press circuit is the possibility of a simple control of the flow of pressures in the space for fluid of the pressure chamber at the moment of the placing and loading of the sheet by the downholder slide on the face of the pressure chamber, and then during the whole course of drawing of the pressing from this sheet blank.

A further effect of the system according to the invention is a distinct saving of energy because a portion of the pressure fluid from the corresponding space of the pressure chamber during drawing returns to the circuit of the main hydraulic press cylinder where the energy of this released pressure fluid is utilized for work in the main hydraulic press cylinder.

Another advantage of the system according to the invention is the fact that refilling of the loss of pressure fluid is eliminated because this fluid circulates in the connected portions of the main circuit of the hydraulic press cylinder and the pressure chamber.

Because it is not necessary to release the fluid from the pressure chamber, where the pressing is formed, to some other space, it is very simple to realize a refilling of the losses due to possible leakages between movable elements of the pressure chamber.

Figure 2:
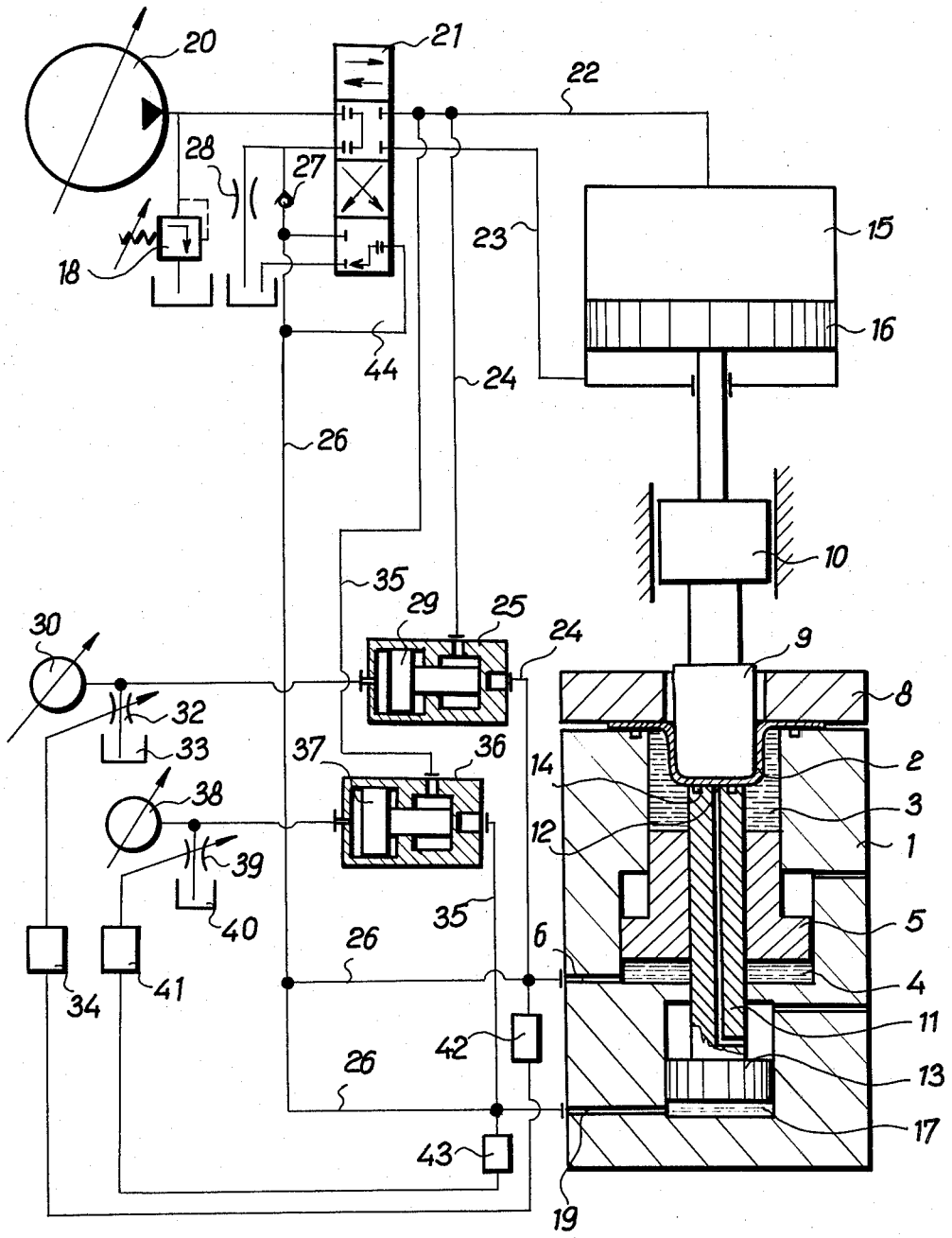

Further advantages and features of the invention appear from the following description of the hydraulic circuit of the press which of course does not cover all further possibilities of arrangement and from the drawings in which:

FIG. 1 is a diagrammatic illustration of a first embodiment of hydromechanical drawing system in accordance with the invention, the system including a pressure chamber shown in longitudinal section and having separate spaces for the fluid, a main hydraulic press circuit, and a novel interconnection to a controlled throttle valve with feedback; and FIG. 2 is a diagrammatic illustration of a second embodiment of the system of the invention, such system including a pressure chamber with separated spaces for the fluid and a floating plunger and means for the interconnection of the various separated spaces for the fluid in the pressure chamber with the main hydraulic press circuit, said means including controlled throttle valves and feedbacks.

Turning now to FIG. 1, the hydromechanical sheet drawing there shown includes a pressure chamber 1 forming in substance the drawing die for a pressing 2 and having at least two spaces 3 and 4 for the fluid, the spaces 3 and 4 being separated by a piston transmitter 5. The space 3 in the pressure chamber 1 is filled with liquid, e.g., water, and the space 4 is preferably filled with a viscous liquid, e.g., oil which constitutes the main filling of the hydraulic press circuit. The space 4 is connected to the hydraulic press circuit by means of a hydraulic outlet duct 6. A duct 7 in the pressure chamber is formed to release liquid which might have leaked around the piston transmitter 5 from either of the spaces 3 and 4 to a drain (not shown).

The pressure chamber 1 is at its top face adapted to receive sheet blanks which in the course of drawing of the pressing 2 are held by a downholder slide 8 of the press. For simplicity of illustration, the hydraulic circuit of the down-holder slide 8 is not shown. A drawing punch 9 on which the pressing 2 is formed is mounted on a drawing slide 10 of the press.

The hydraulic circuit of the press includes in substance a hydrogenerator or pump 20 which is the source of the pressure medium, e.g., hydraulic pressure oil for the main working cylinder 15 of the press, a hydraulic distributor 21 for the alternate distribution of pressure fluid to beneath and above the piston 16 of the main hydraulic press cylinder 15, and conduits 22, 23 for the hydraulic connection of the means 20 and 15. To the hydraulic distributor 21 there is further attached a regulating throttle valve 18. The pressure medium is supplied through the pressure branch 22 connected to the main working cylinder 15 above the piston 16 to produce the downward working stroke of the piston 16, in which stroke the slide 10 and the drawing punch 9 perform the drawing movement of the press. After the shifting of the hydraulic distributor 21, the pressure branch 23 conducts pressure fluid from the hydrogenerator 20 under the piston 16 to produce the return, upward movement of the slide 10 and the punch 9.

The hydraulic outlet 6 of the space 4 of the pressure chamber 1 is connected to the conduit 22 by means of a communication branch 24 in which there is interposed a throttle element such as a controlled throttle valve 25, as shown. Other throttle elements such as an orifice plate may be used in place of valve 25.

To the hydraulic outlet 6 of the space 4 of the pressure chamber 1 there is connected in parallel with branch 24 a filling branch 26 provided with a check valve 27. The filling branch 26 is connected to a suitable outlet of the hydraulic distributor 21 to ensure the flow of the pressure fluid from the hydrogenerator 20 through the filling branch circuit 26 into the space 4 of the pressure chamber 1 at the moment when both pressure branches 22 and 23 for the main working cylinder 15 are closed and thus the press is then out of operation. A by-pass 44 is provided whereby the branch conduit 44 is connected to the drain by a suitable shifting of the hydraulic distributor 21. To adjust a suitable overpressure in the filling branch 26 and thus also in the fluid space 4 of the pressure chamber 1, there is connected to the filling branch 26 a pressure relief outlet valve 28 (or a throttling plate or some other type of hydraulic element responding, e.g., by opening when the fluid being checked attains a pressure exceeding the preset value).

The function of the controlled throttle valve 25 in the connecting branch 24 is governed by a piston 29 which is subjected to the fluid pressure medium from a supplementary hydrogenerator or pump 30 supplied to valve 25 by a connecting branch conduit 31. The pressure of the pressure medium supplied by pump 30 acting on the piston 29 of the controlled throttle valve 25 varies, e.g., by varying the pressure in the conduit branch 31 by means of a controlled throttle valve 32 discharging into a drain 33, the operation of the controlled throttle valve 32 being effected, for example, by an actuator 34 which is controlled by a pressure sensor 42 checking the pressure of fluid in the space 3 of the pressure chamber 1. The system comprising the pressure sensor 42, actuator 34, and controlled throttle valve 32 constitutes the feedback circuit for a control throttle valve 25 which regulates the pressure in the pressure chamber 1 or produces a pressure gradient of the pressure fluid in the branch conduit 24.

The operation of the controlled throttle valve 25 is controlled independently, e.g., by its piston 29 incorporated in a feedback circuit which includes hydrogenerators 30 as a reference source of pressure fluid, controlled throttle valve 32 terminating into outlet 33, and actuator 34 to which is adjoined a pressure sensor 42 checking independently the pressure of fluid in the space 4 of the pressure chamber 1.

The hydraulic press circuit according to the invention is completed by a device (not shown) for refilling losses of fluid, i.e., of water in the space 3 of the pressure chamber 1.

The function of the above-described hydraulic circuit shown in FIG. 1 is as follows:

Before beginning the drawing of the sheet pressing 2 in the pressure fluid in the space 3 of the pressure chamber 1, the space 4 of the pressure chamber 1 is filled with pressure fluid, i.e., hydraulic oil supplied into the said spaces 4 through the filling branch 26 from the supply outlet of the hydraulic distributor 21 from the hydrogenerator 20.

During the filing of the space 4 of the pressure chamber 1 with pressure fluid, the plunger of the piston transmitter 5 moves up to its upper predetermined position which in principle defines the volume of the space 3 for the fluid of the pressure chamber 1. The space 3 is refilled by simple filling means (not shown) up to the top edge of the pressure chamber 1 by a quantity compensating for the loss of fluid in this space 3 due to previous possible leakage and handling of the previous pressing 2 after completion of its drawing.

The pressure of the pressure fluid supplied by the filling branch 26 into the said space 4 of the pressure chamber 1 is controlled by the release valve 28 of the hydraulic distributor 21.

After filling the space 3 with liquid a sheet blank is placed on the upper face of the pressure chamber 1 and is loaded on its periphery by the downholder slide 8. After the shifting of the hydraulic distributor 21, the pressure fluid from the hydrogenerator 20 is transferred by the pressure branch 22 above the piston 16 of the main working cylinder 15 of the press whereby the piston 16 and slide 10 of the press with drawing punch 9 is actuated to perform its working stroke. The drawing punch 9 at the moment of the beginning of the drawing operation upon the pressing 2 generates an increase of pressure in the fluid in the space 3 of the pressure chamber 1, as is usual in the hydromechanical device for drawing the sheet pressing 2. In view of the fact that the fluid from the space 3 of the pressure chamber 1 is not released to any other space, the piston transmitter 5 begins, in relation to the penetration of the drawing punch 9 into the space 3 of the pressure chamber 1, to recede from its upper preset position. In doing this, the piston transmitter 5 expels the pressure fluid from the space 4 of the pressure chamber 1 into the hydraulic outlet 6 in the pressure chamber 1.

The pressure of the fluid being expelled from the hydraulic outlet 6 of the pressure chamber 1 causes the closing of the return valve 27 in the filling branch 26 and the flow of this pressure fluid through the connection branch 24 via the controlled throttle valve 25 into the pressure branch 22 connected to the main working cylinder 15 of the press. The regulation of the flow of the pressure fluid expelled into the hydraulic outlet 6 is obtained by throttling by means of the said controlled throttle valve 25 which is actuated by feedback means in relation to the pressure of fluid in the space 4 of the pressure chamber 1 checked by pressure sensor 42. By throttling the flow of pressure fluid in the pressure branch 22 foı the main working cylinder 15 of the press is maintained at the required value of pressure of the pressure fluid in the space 4 of the pressure chamber 1 which by feedback affects the required higher pressure fluid from the space 4 of the pressure chamber 1 via the controlled throttle valve 25 into the pressure branch 22 a saving of energy is obtained which accumulates during the working stroke of the slide 10 of the press in the space 3 of the pressure chamber 1 because energy is not destroyed by releasing high pressure fluid from the said space 3 to the drain but is transformed into the space 4 of the pressure chamber 1 and after a certain loss of it due especially to throttling of the released pressure fluid in the controlled throttle valve 25 is transmitted to the pressure branch 22 or into the main working cylinder 15 of the press where it supports the action of the piston 16 in its working stroke together with the slide 10. The value of the force of the slide 10 in its working stroke can be only such to overcome the deformation resistance of the material of the sheet blank for the pressing 2 and suffice to produce a pressure gradient in the pressure fluid flowing in the connection branch 24 via controlled throttle valves 25 from the respective hydraulic outlet 6 of the pressure chamber 1 into the pressure branch 22.

It must be added that the pressure sensor 42 may sense the pressure of fluid directly in the space 3 of the pressure chamber 1. This pressure situation in the hydraulic circuit of the press and in the pressure chamber 1 with separated spaces for the fluid is created under the condition that the diameter of the piston 16 of the main working cylinder 15 of the press is always greater than the maximum diameter of the piston transmitter 5 in the pressure chamber 1. From the above it follows that the pressure in the space 4 of the pressure chamber 1 is always greater than the pressure in the main working cylinder 15 of the press above the piston 16 but smaller than the pressure in the space 3 for fluid in the pressure chamber 1.

After completion of the drawing operation of the sheet pressing 2, decompression is produced in the spaces 3, 4 for the fluid in the pressure chamber 1, by suitable shifting of the hydraulic distributor 21 whereby the filling branches 26 by means of the by-pass 44 are connected to the drain. Afterwards or simultaneously with this, the piston 16 of the main working cylinder 15 of the press together with the slide 10 are set into return, upward motion.

In the embodiment of FIG. 2, wherein elements similar to those of FIG. 1 are designated by the same reference characters, the pressure chamber 1 also includes, besides the spaces 3 and 4 for the fluid, a separate space 17 for the fluid into which the free end 13 of a floating plunger 11 penetrates.

The floating plunger 11 is arranged axially slidably in the piston transmitter 5. The free end 12 of the floating plunger 11 fitted with a seal 14 is adapted to bear against the lower face of the bottom of the drawn pressing 2 on which it exerts a controlled counterpressure during the drawing process.

The hydraulic circuit for the control of this modified design of the pressure chamber 1 (FIG. 2) also includes a hydrogenerator 20 as the source of pressure medium for the main hydraulic cylinder 15 of the press, a hydraulic distributor 21, and pressure branches 22, 23 connected thereto for distributing pressure fluid under and above the piston 16 of the said main hydraulic working cylinder 15 to produce its downward working stroke and its upward return stroke. To the hydraulic distributor 21 there is adjoined a regulating release valve 18.

To the pressure branch 22 there is connected first a hydraulic outlet 6 of the pressure chamber 1 by means of the connection branch 24, and secondly, a hydraulic outlet 19 from the space 17 of the pressure chamber 1 by means of a connection branch 35. In each of the connection branches 24 and 35 there are incorporated controlled throttle valves 25 and 36 or other types of throttle elements, e.g., orifice plates or sim.

To the hydraulic outlet 6 and hydraulic outlet 19 of the pressure chamber 1 there are connected in parallel two filling branches 26 opening from the common outlet of the hydraulic distributor 21, and in the common section of the filling branches 26 there are incorporated a check valve 27. For the adjustment of a suitable overpressure in the filling branches 26 and thus also in the spaces 4 and 17 of the pressure chamber 1 for the fluid during their filling by fluid, there is adjoined to the filling branches 26 a release valve 28 or throttling plate or some other hydraulic element which opens when the selected value of the pressure of the medium being checked is exceeded.

The operation of the controlled throttle valves 25 and 36 is controlled independently by their pistons 29 and 37, respectively, incorporated in feedback circuits which include two hydrogenerators 30 and 38 as reference sources of pressure fluid, controlled throttle valves 32 and 39 terminating into outlets 33 and 40, and respective actuators 34 and 41 to which there are adjoined pressure sensors 42 and 43 which independently check the pressure of fluid in the spaces 4 and 17 of the pressure chamber 1 or in portions of the connection branches 24 and 35 at the respective hydraulic outlets 6 and 19 of the pressure chamber 1.

The hydraulic press circuit of FIG. 2 is completed by a device (not shown) for refilling losses of fluid, i.e., of water in the space 3 of the pressure chamber 1.

The function of the above-described hydraulic circuit of FIG. 2 is as follows:

Before the beginning of the drawing of the sheet pressing 2 in the pressure fluid of the space 3 of the pressure chamber 1 the space 17 of the pressure chamber 1 is filled with pressure fluid, i.e., hydraulic oil supplied into the said space 17 through the filling branches 26 from the respective supply outlet of the hydraulic distributor 21 from the hydrogenerator 20.

During filling of the space 17 of the pressure chamber 1 with pressure fluid, the floating plunger 11 in the piston transmitter 5 moves up to its upper predetermined position which in principle defines the volume of the space 3 for the fluid of the pressure chamber 1, whereupon by simple filling means (not shown) the space 3 is refilled up to the top edge of the pressure chamber 1 by a quantity compensating for the loss of fluid in this space 3 due to previous possible leakage and handling the pressing 2 after completion of the drawing.

The pressure of the pressure fluid supplied by the filling branches 26 into the said space 17 of the pressure chamber 1 is controlled by the release valve 28 of the hydraulic distributor 21.

After filling the space 3 with liquid, a sheet blank is placed on the upper face of the pressure chamber 1 and is loaded on its periphery by the downholder slide 8. After shifting of the hydraulic distributor 21, the pressure fluid with the hydrogenerator 20 is transferred by the pressure branch 22 above the piston 16 of the main working cylinder 15 of the press whereby the piston 16 and slide 10 of the press with drawing punch 9 is actuated to perform its working stroke. The drawing punch 9 at the moment of beginning of the drawing operation of the pressing 2 generates an increase of pressure in the fluid in the space 3 of the pressure chamber 1 as is usual in the hydromechanical device for drawing the sheet pressing 2. In view of the fact that the fluid from the space 3 of the pressure chamber 1 is not released to any other space, the floating plunger 11 begins, in relation to the penetration of the drawing punch 9 into the space 3 of the pressure chamber 1, to recede from its upper preset position. In doing this, the floating plunger 11 expels the pressure fluid from the space 17 of the pressure chamber 1 into the respective hydraulic outlet 19 in the pressure chamber 1.

The pressure of the fluid being expelled from the hydraulic outlet 19 of the pressure chamber 1 causes the closing of the return valve 27 in the filling branches 26 and of the flow of this pressure fluid through the connection branch 35 via the controlled throttle valves 25 or also 36 into the pressure branch 22 connected to the main working cylinder 15 of the press. The regulation of the flow of the pressure fluid expelled into the hydraulic outlet 19 is obtained by throttling by means of the said controlled throttle valves 25 and 36 which are actuated by feedback means in relation to the pressure of fluid in the spaces 4 and 17 of the pressure chamber 1 checked by pressure sensors 42 and 43. By throttling the flow of pressure fluid in the pressure branch 22 for the main working cylinder 15 of the press, the required value of the pressure of the pressure fluid in the space 4 or the space 17 of the pressure chamber is maintained, which by feedback affects the required higher pressure of the fluid in the space 3 of the pressure chamber 1 during drawing of the sheet pressing 2.

The pressure sensors 42 and 43 may sense the pressure of fluid directly in the space 3 of the pressure chamber 1. This pressure situation in the hydraulic circuit of the press and in the pressure chamber 1 with separated spaces for the fluid is created under the condition that the diameter of the piston 16 of the main working cylinder 15 of the press is always greater than the sum of the active surface of the maximum diameter of the piston transmitter 5 and the free end 13 of the plunger 11 entering into the space 17 of the pressure chamber 1. From the above follows the fact that the pressure in the space 4 of the pressure chamber 1 is always greater than the pressure in the main working cylinder 15 of the press above the piston 16 but smaller than the pressure in the space 3 for fluid in the pressure chamber 1.

The pressure of the pressure fluid in the space 17 of the pressure chamber 1 under the free end 13 of the floating plunger may be different from the pressure of the pressure fluid in the space 4 of the pressure chamber 1. Due to the arrangement described, however, even here the pressure must be higher than the pressure of the pressure of the pressure fluid in the pressure branch 22 or in the main working cylinder 15 of the press to produce the respective pressure gradient in the connection branch 35 behind the controlled throttle valve 36. This condition need not be fulfilled in case the controlled throttle valve 36 is replaced by a simple adjustable throttle valve with an outlet terminating into a drain (not shown). By releasing pressure fluid from the space 4 or space 17 of the pressure chamber 1 via the controlled throttle valve 25 or 36 into the pressure branch 22, a saving of energy is obtained which accumulates during the working stroke of the slide 10 of the press in the space 3 of the pressure chamber 1 because energy is not destroyed by releasing high pressure fluid from the said space 3 to the drain but is transformed into the space 4 or the space 17 of the pressure chamber 1 and after a certain loss of it due especially to throttling of the released pressure fluid in the controlled throttle valves 25 and 36 is transmitted to the pressure branch 22 or into the main working cylinder 15 of the press where it supports the action of the piston 16 in its working stroke together with the slide 10. The value of the force of the slide 10 in its working stroke can be only such as to overcome the deformation resistance of the material of the sheet blank for the pressing 2 and suffice to produce a pressure gradient in the pressure fluid flowing in the connection branch 24 or 35 via controlled throttle valves 25 or 36 from the respective hydraulic outlets 6 and 19 of the pressure chamber 1 into the pressure branch 22.

After completion of the drawing operation of the sheet pressing 2, decompression is produced in all spaces 3, 4, or 17 for the fluid in the pressure chamber by suitable shifting of the hydraulic distributor 21 whereby the filling branches 26 by measn of the by-pass 44 are connected to the drain. Afterwards or simultaneously with this, the piston 16 of the main working cylinder 15 of the press together with the slide 10 are set into return motion.

It will be apparent from the said description that the pressure fluid expelled from the hydraulic outlet 6 (FIG. 1) and 19 (FIG. 2) of the pressure chamber may be released into any hydraulic unit of the press which is the source of force for the forming of the pressing 2, be it the described main working cylinder 15 of the press, e.g., an auxiliary working cylinder (not shown), or a hydraulic unit (not shown) for the control of the downholder slide 8 of the press, or a hydraulic unit arranged directly in the body of the drawing punch 9 for the independent control of one of the parts of the drawing punch 9 if a combined punch 9 is involved. Regarding the arrangement of the said hydraulic units whose function either depends directly on the pressure fluid as is the case, i.e., for the main cylinder 15 of the press, these hydraulic units are oriented in the direction of the main movement of the drawing punch 9 of the drawing slide 10.

Although the invention is illustrated and described with reference to a plurality of preferred embodiments thereof, it is to be expressly understood that it is in no way limited by the disclosure of such a plurality of embodiments, but is capable of numerous modifications within the scope of the appended claims.

We claim:

1. In the combination of a hydromechanical press for the drawing of a workpiece made of material in sheet form, the press having a body providing a fluid pressure chamber with a first space therein including a first cylinder, said first space receiving a first fluid which forms an external drawing die, the pressure chamber also having a second space therein including a second cylinder, said second space receiving a second fluid, a force transmitter separating the first and second spaces and having connected first and second pistons sealingly engaging and reciprocable in the said first and second cylinders, respectively, the press having a third, main working cylinder spaced from said body and having a working pressure side, a piston reciprocable in the main working cylinder and provided with a piston rod movable toward away from the first space in the body, a drawing punch mounted on the outer end of the piston rod for drawing a sheet workpiece in cooperation with the fluid in the first space in the body, and a source of fluid pressure selectively connectible with the pressure side of the main working cylinder to thrust the drawing punch toward the first space in the body and a sheet workpiece into said first space, whereby the improvement which comprises a conduit connecting the working pressure side of the main working cylinder to the second space in the fluid pressure chamber, and a first, controlled throttle valve interposed in said conduit.

2. The combination according to claim 1, comprising a hydraulic distributor interposed between the source of fluid pressure and the pressure side of the main working cylinder, a filling branch conduit connected between the distributor and the second fluid space, and a check valve interposed in the filling branch conduit to prevent the escape of fluid from the second space through the filling branch conduit.

3. The combination according to claim 1, wherein the first, controlled throttle valve is controlled by fluid pressure operated means, and comprising an auxiliary separate fluid pressure source supplying fluid under a predetermined, reference pressure, conduit means connecting the auxiliary fluid pressure source to the fluid pressure operated means for controlling the first throttle valve, and a second throttle valve for controlling the pressure in said conduit means.

4. The combination according to claim 3, comprising sensor means for sensing the pressure of the fluid in said first space in the pressure chamber, and means responsive to the sensor for controlling the second throttle valve.

5. The combination of claim 4, wherein the second throttle valve bleeds the fluid from the conduit means at a rate controlled by the sensor.

6. The combination according to claim 2, comprising a by-pass conduit means connected between the filling branch conduit and the inlet of the hydraulic distributor, the hydraulic distributor having a decompression outlet which is selectively connected to the by-pass conduit.

* * * * *

UNITED STATES PATENT AND TRADEMARK OFFICE

CERTIFICATE OF CORRECTION

PATENT NO. : 4,229,965

DATED : October 28, 1980

INVENTOR(S) : SPACEK et al.

It is certified that error appears in the above–identified patent and that said Letters Patent are hereby corrected as shown below:

On The Title Page,

In the listing of inventors on the first page, on the second line, delete "both of Czechoslovakia" and insert therefor the following:

--Vaclav SMRCEK, Brno; Vaclav PENAZ, Zdar; Jan HRDINA, Zdar; Miroslav SYKORA, Nove Veseli; Jaroslav HAJEK, Zdar; all of Czechoslovakia--

Signed and Sealed this

*Twenth-eighth* Day of *September 1982*

[SEAL]

*Attest:*

GERALD J. MOSSINGHOFF

*Attesting Officer*

*Commissioner of Patents and Trademarks*